US010046560B2

(12) United States Patent
Wagner et al.

(10) Patent No.: US 10,046,560 B2
(45) Date of Patent: Aug. 14, 2018

(54) METHODS AND APPARATUS TO CONTROL A HEATER ASSOCIATED WITH A PRINTING NOZZLE

(71) Applicant: HEWLETT-PACKARD DEVELOPMENT COMPANY, L.P., Houston, TX (US)

(72) Inventors: Jeffrey Allen Wagner, Vancouver, WA (US); Ronald Albert Askeland, San Diego, CA (US); Maria Magdalena Martinez Ferrandiz, Sant Cugat del Valles (ES); Maria Dinares Argemi, Terrassa (ES); Francisco Lopez Moral, Castellbisbal (ES); Xavier Bruch, Sant Cugat del Valles (ES); Chandrasekhar Nadimpalli, Sant Cugat del Valles (ES); Xavier Gasso Puchal, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/500,660

(22) PCT Filed: Jul. 31, 2014

(86) PCT No.: PCT/US2014/049258
§ 371 (c)(1),
(2) Date: Jan. 31, 2017

(87) PCT Pub. No.: WO2016/018396
PCT Pub. Date: Feb. 4, 2016

(65) Prior Publication Data
US 2017/0217161 A1 Aug. 3, 2017

(51) Int. Cl.
*B41J 2/045* (2006.01)

(52) U.S. Cl.
CPC ..... *B41J 2/04515* (2013.01); *B41J 2/0457* (2013.01); *B41J 2/0458* (2013.01); *B41J 2/04548* (2013.01)

(58) Field of Classification Search
CPC .. B41J 2/04515; B41J 2/04548; B41J 2/0457; B41J 2/0458
See application file for complete search history.

(56) References Cited

U.S. PATENT DOCUMENTS

| | | | |
|---|---|---|---|
| 5,992,964 | A | 11/1999 | Yamaguchi |
| 6,102,518 | A | 8/2000 | Taylor |
| 6,390,585 | B1 | 5/2002 | Schiaffino et al. |
| 6,481,824 | B1 | 11/2002 | Hayakawa et al. |

(Continued)

FOREIGN PATENT DOCUMENTS

| | | |
|---|---|---|
| JP | 08300684 | 11/1996 |
| WO | WO-02096652 | 12/2002 |
| WO | WO-2014/046658 | 3/2014 |

*Primary Examiner* — Ahn T. N. Vo
(74) *Attorney, Agent, or Firm* — Hanley Flight & Zimmerman, LLC

(57) ABSTRACT

Methods and apparatus to control a heater associated with a printing nozzle are disclosed. A method comprising controlling a heater associated with a printing nozzle to reduce a heat output of the heater based on a determination that the printing nozzle is outside a print area and printing an image on a substrate using other printing nozzles while the heat output of the heater is reduced.

14 Claims, 6 Drawing Sheets

(56) References Cited

U.S. PATENT DOCUMENTS

| | | | | |
|---|---|---|---|---|
| 6,578,947 | B1 | 6/2003 | Suwabe et al. | |
| 6,585,343 | B2 | 7/2003 | Bauer | |
| 6,634,731 | B2 * | 10/2003 | Kao | B41J 2/04515 347/14 |
| 6,767,076 | B2 | 7/2004 | Silverbrook et al. | |
| 7,029,091 | B2 | 4/2006 | Stellbrink et al. | |
| 7,163,272 | B2 * | 1/2007 | Parish | B41J 2/04563 347/14 |
| 7,341,324 | B2 | 3/2008 | Juve et al. | |
| 7,384,115 | B2 | 6/2008 | Barkley | |
| 7,753,484 | B2 | 7/2010 | Silverbrook et al. | |
| 7,762,647 | B2 | 7/2010 | Mehta et al. | |
| 7,926,898 | B2 | 4/2011 | Snyder et al. | |
| 7,986,439 | B2 * | 7/2011 | Walmsley | G06F 21/606 358/1.14 |
| 8,033,631 | B2 * | 10/2011 | Kanno | B41J 2/04541 347/17 |
| 8,172,369 | B2 | 5/2012 | Bergstedt et al. | |
| 8,500,231 | B2 | 8/2013 | Nishihara | |
| 8,556,398 | B2 | 10/2013 | Gunnell et al. | |
| 8,579,410 | B1 | 11/2013 | Simmons | |
| 8,664,297 | B2 | 3/2014 | Fujii | |
| 2002/0033856 | A1 | 3/2002 | Moon et al. | |
| 2007/0291066 | A1 * | 12/2007 | Takabayashi | B41J 2/04563 347/17 |
| 2009/0147042 | A1 | 6/2009 | McAvoy et al. | |
| 2009/0147044 | A1 | 6/2009 | McAvoy et al. | |
| 2010/0143581 | A1 | 6/2010 | Eldershaw et al. | |

* cited by examiner

METHODS AND APPARATUS TO CONTROL A HEATER ASSOCIATED WITH A PRINTING NOZZLE

BACKGROUND

Inkjet printing devices include a printhead having a number of nozzles. The nozzles are used to eject fluid (e.g., ink) onto a substrate to form an image. Some inkjet printing devices include a stationary printbar that includes printheads. Such printing devices are known as wide array printers (e.g., page wide array printers). The printbar of a wide array printer spans the width of a printable area of the printer such that the printbar may remain stationary during printing. A substrate to be printed is moved past the stationary printbar of the wide array printer.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

In a wide array printing apparatus or other printing apparatus including a printbar, the size of a substrate being imaged may be smaller than a size of the printbar. When the substrate is smaller than the printbar, some nozzles (or printheads) overlying the substrate may be used to image the substrate and some nozzles (or printheads) that are spaced away from the substrate may not be used to image the substrate. In another example, a section of the substrate may be left blank during the printing (e.g., a margin or other area where no printing is to occur based on the image to be printed). When a section of the substrate is left blank, some nozzles (or printheads) overlying the image may be used to image the substrate and some nozzles (or printheads) overlying the blank section of the substrate may not be used to image the substrate.

If a nozzle of a printhead is not being used, heated ink within the nozzle may come into contact with air and start to evaporate, dry up and/or separate. When ink evaporates within a nozzle there may be a loss of ink and/or print quality may be impacted by dried ink in the nozzle. Ink drying and evaporation may be accelerated when a heater is used to heat the ink to decrease ink viscosity during printing. Examples disclosed herein maintain the operability of inkjet devices by heating (or not heating) printheads or nozzles based on a location of the printheads or nozzles and a print area for an image to be printed. In some examples, while printing to a substrate, some of the printheads or nozzles are heated to decrease the viscosity of the ink for printing and other printheads or nozzles are not heated to reduce evaporation and/or drying of printheads that are not used. Additionally or alternatively, a cooling element may be activated to cool printheads or nozzles that are not in use.

In some examples, the print area is determined by the dimensions of the substrate. In another example, the print area is determined by the dimensions of the image to be printed on the substrate. In some examples, the print area is determined by both of the dimensions of the substrate and the dimensions of the image to be printed on the substrate.

Figure 1:
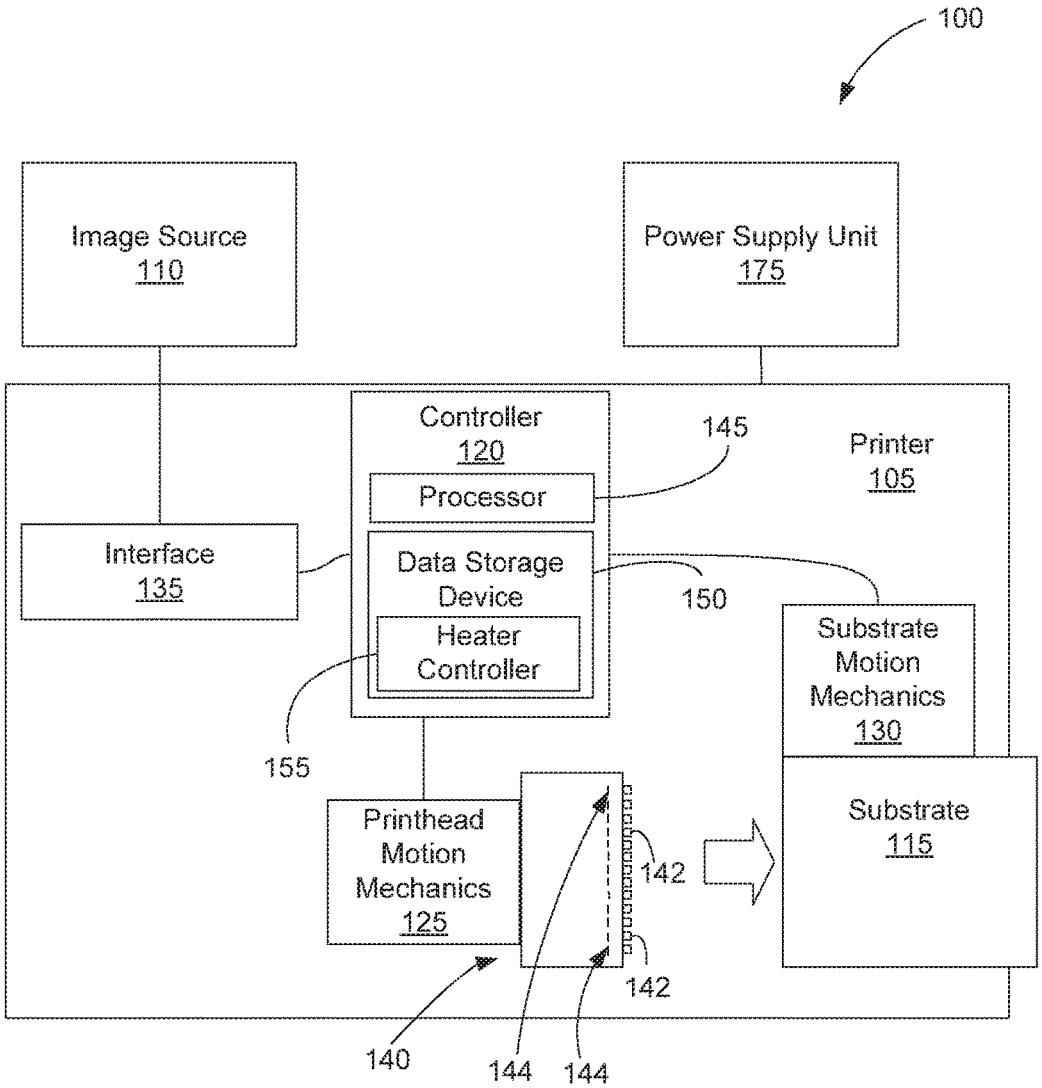
FIG. 1 is a schematic illustration of an example printing apparatus that can be used to implement the examples disclosed herein.

FIG. 1 is a block diagram of an example printing apparatus 100 that can be used to implement the teachings of this disclosure. The example printing apparatus 100 of FIG. 1 includes a printer 105, an image source 110 and a substrate (e.g., paper) 115. The image source 110 may be a computing device from which the printer 105 receives data describing a print job to be executed by a controller 120 of the printer 105 to print an image on the substrate 115.

In the example of FIG. 1, the printing apparatus 100 also includes printhead motion mechanics 125 and substrate motion mechanics 130. In some examples, the printhead and substrate motion mechanics 125, 130 include mechanical devices that move a printhead 140 and/or the substrate 115, respectively, when printing an image on the substrate 115. In some examples, instructions to move the printhead 140 and/or the substrate 115 may be received and processed by the controller 120 (e.g., from the image source 110). In some examples, signals may be sent to the printhead 140 and/or the substrate motion mechanics 130 from the controller 120.

The example printer 105 of FIG. 1 includes an interface 135 to interface with the image source 110. The interface 135 may be a wired or wireless connection connecting the printer 105 and the image source 110. The image source 110 may be a computing device from which the printer 105 receives data describing a print job to be executed by the controller 120. In some examples, the interface 135 enables the printer 105 and/or a processor 145 to interface with various hardware elements, such as the image source 110 and/or hardware elements that are external and/or internal to the printer 105. In some examples, the interface 135 interfaces with an input or output device such as, for example, a display device, a mouse, a keyboard, etc. The interface 135 may also provide access to other external devices such as an external storage device, network devices such as, for example, servers, switches, routers, client devices, other types of computing devices and/or combinations thereof.

In the illustrated example, the printer 105 includes the example printhead 140 having a plurality of nozzles 142. The plurality of nozzles 142 are provided with a plurality of heaters 144. The heaters 144 may be similar or different from one another. The heaters 144 may be implemented using, for example, small thin film resistors, field effect transistors (FET's), and/or any other type of heater inside or outside the printhead 140 and/or nozzles 142. The example heaters 144 each heat a particular nozzle 142. Alternatively, the heaters 144 may heat an entire printhead comprising multiple ones of the nozzles 142.

In some examples, to reduce evaporation and drying of ink within the nozzles 142, an example heater controller 155 stored in a data storage device 150 and executed by the processor 145 may control the heaters 144 between an on state and an off state. In some examples, the heater controller 155 causes some of the heaters 144 to be turned off when those heaters 144 are associated with ones of the nozzles 142 that are not being used during a printing operation and causes other of the heaters 144 to be turned on when those respective ones of the heaters 144 are associated with ones of the nozzles 142 that are being used during the printing operation. In some examples, the nozzles 142 that are not being used during a printing operation are outside of a printing area and are at a distance from a perimeter edge of a substrate to be imaged and/or at a distance from a perimeter edge of an image to be printed.

The example controller 120 includes the example processor 145 including hardware architecture to retrieve and execute executable code from the example data storage device 150 which contains the example heater controller 155. The executable code may, when executed by the example processor 145, cause the processor 145 to implement at least the functionality of printing on the example substrate 115, actuating the printhead and/or substrate motion mechanics 125, 130 and controlling the heaters 144. The executable code may, when executed by the example processor 145, cause the processor 145 to provide instructions to a power supply unit 175 to cause the power supply unit 175 to provide power to the printhead 140 to eject a fluid from the nozzles 142 and/or to control the heaters 144.

The data storage device 150 of FIG. 1 stores data, such as executable program code, that is executed by the example processor 145 or other processing devices. The example data storage device 150 may store computer code representing a number of applications, including the example heater controller 155, that the example processor 145 executes to implement the examples disclosed herein. The example heater controller 155 determines a print area based on substrate and image dimensions, identifies a subset of the nozzles 142 that are located within the print area, and controls the example heaters 144 to selectively heat the subset of the nozzles 142 that are inside the print area (e.g., to decrease ink viscosity during printing) while reducing heating (e.g., by reducing power to the heaters 144, disabling the heaters 144, etc.) of the nozzles 142 that are outside the print area.

Figure 2:
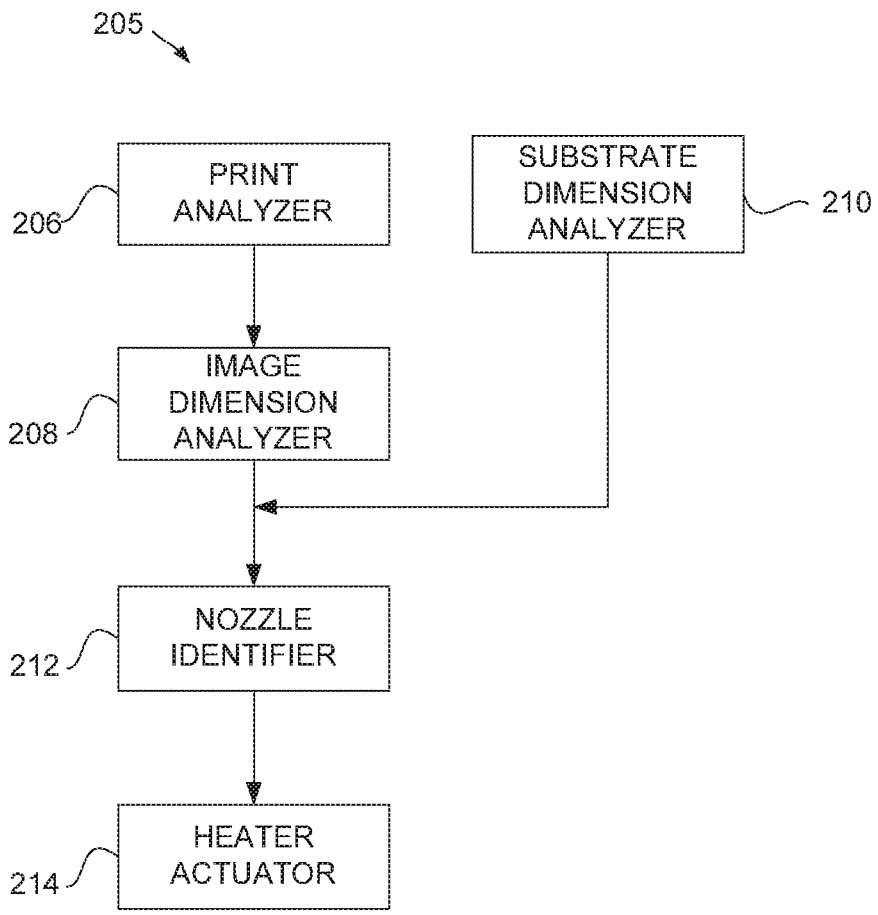
FIG. 2 is a block diagram of an example implementation of a heater controller.

FIG. 2 is a block diagram of an implementation of an example heater controller 205. The example heater controller 205 of FIG. 2 may be used to implement the example heater controller 155 of FIG. 1. The heater controller 205 of the illustrated example includes an example print analyzer 206, an example image dimension analyzer 208, an example substrate dimension analyzer 210, an example nozzle identifier 212, and an example heater actuator 214.

The example print analyzer 206 receives information about requested print jobs from the image source 110. A print job may be comprised of print commands and print data associated with the print job that may be used by the example printing apparatus 100 to produce a desired image (e.g., text, graphics, etc.) on the substrate 115. The print data may contain information such as substrate dimensions, image dimensions, image colors, etc.

The example image dimension analyzer 208 determines the dimensions of the image from the print data. According to the illustrated example, the image dimensions are identified in the print data. Alternatively, the image dimension analyzer 208 may analyze the print data to determine the image dimensions (e.g., by determining the width and/or height of the image to be printed).

The example substrate dimension analyzer 210 determines the dimensions of a substrate on which the image will be printed (e.g., the substrate 115 from FIG. 1). The example substrate dimension analyzer 210 determines the substrate dimensions by requesting dimension information from firmware of the printing apparatus (e.g., from the controller 120 of the printing apparatus 100). Alternatively, the substrate dimension analyzer 210 may determine the dimensions of the substrate 115 by analyzing data from the print analyzer 206 (e.g., by analyzing the print data) or from any other source.

The nozzle identifier 212 of the illustrated example identifies a subset of nozzles (e.g., a subset of the nozzles 142 from FIG. 1) that are within a print area. Additionally or alternatively, the nozzle identifier 212 may identify a subset of the nozzles that are outside a print area. According to the illustrated example, nozzles are inside the print area when they will be utilized for printing an image (e.g., an image received from the image source 110). Alternatively, nozzles may be identified as being in the print area when they are located within an area in which printing will occur. For example, in a page wide array printer, nozzles may be inside the print area when the nozzles are located along a printbar within the width of the substrate (e.g., the substrate will pass below the nozzles during printing).

The example nozzle identifier 212 determines the print area by analyzing both the example image dimension analyzer 208 and the example substrate dimension analyzer 210 to determine the largest dimension and, thereby, the nozzles that are within the print area. Alternatively, the nozzle identifier 212 may utilize information from one of the image dimension analyzer 208 and the substrate dimension analyzer 210.

The example heater actuator 214 receives the identified nozzles from the nozzle identifier 212 and activates heaters associated with the nozzles that are within the print area (e.g., the heaters 144 that are associated with identified ones of the nozzles 142 of FIG. 1). Activating the heaters may include toggling transistor(s) to control power to the heaters, leaving on a heater that is already activated, etc. The heater actuator 214 may, alternatively, de-activate heaters that are outside the print area. For example, the heater actuator 214 may toggle transistor(s) to disconnect power to the heaters, may leave the heaters off when they are already off, etc. In some examples, the heater actuator 214 may be associated with a group of the nozzles 142 of FIG. 1. If, for example, a particular one of the nozzles 142 within such a group is within the print area, the example heater actuator 214 associated with that group of nozzles will be activated (or continue to be activated). If, for example, all of the nozzles 142 within the group are determined to not be within the print area, then the example heater actuator 214 associated with that group of nozzles will be deactivated (or remain deactivated). Alternatively, any other approach to grouping and activating/deactivating the heater actuator 214 may be utilized.

Thus, the example heater controller 205 controls heaters associated with nozzles of printheads (e.g., printheads on a printbar of a wide array printer) to prevent unnecessary heating of the nozzles that are outside the print area.

Figure 3:
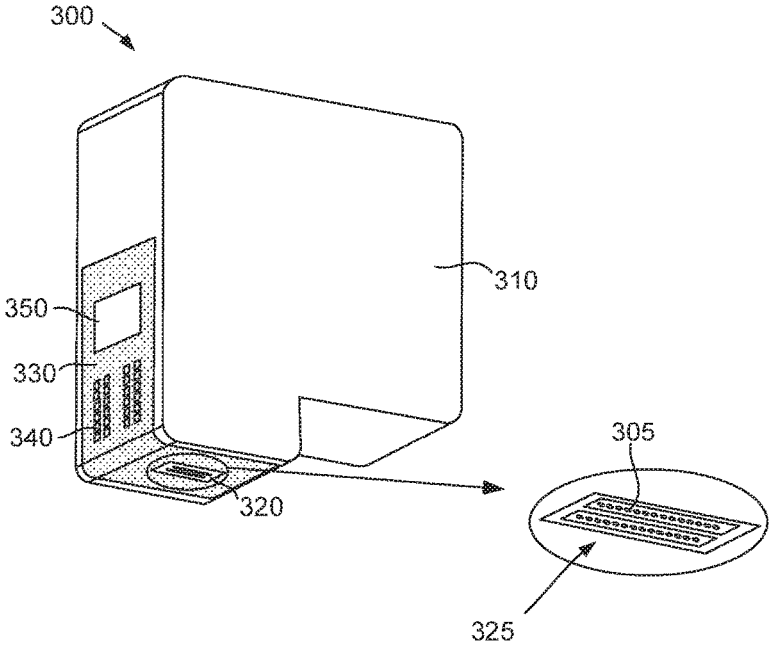
FIG. 3 illustrates an example printing cartridge for use with a printing apparatus that can be used to implement the examples disclosed herein.

FIG. 3 is a block diagram of an example printing cartridge 300 that can be used to implement the example printing apparatus 100 of FIG. 1. In this example, the printing cartridge 300 includes nozzles 305, an example fluid reservoir 310, an example die 320, an example flexible cable 330, example conductive pads 340 and an example memory chip 350. The example flexible cable 330 is coupled to the sides of the cartridge 300 and includes traces that couple the example memory 350, the example die 320 and the example conductive pads 340.

The nozzles 305 of the cartridge 300 of the illustrated example include heaters 325 that are controllable between an on state and an off state. In some examples, a first subset of nozzles 305 may eject a first color of ink while a second subset of nozzles 305 may eject a second color of ink. Thus, if the image being printed uses the first subset of nozzles 305, the heaters 325 of the second subset of nozzles 305 may be turned off to substantially prevent ink in the unused nozzles 305 from evaporating. However, the cartridge 300 may have any number of nozzle groupings that are associated with any number of colors (e.g., 1, 3, 4, etc.) and/or other logical grouping of the nozzles 305. Alternatively, the nozzles 305 may not be grouped.

In operation, the example cartridge 300 may be installed in a carriage cradle of, for example, the example printer 105 of FIG. 1. When the example cartridge 300 is installed within the carriage cradle, the example conductive pads 340 are pressed against corresponding electrical contacts in the cradle to enable the printer 105 to communicate with and/or control the electrical functions of the cartridge 300. For example, the example conductive pads 340 enable the printer 105 to access and/or write to the example memory chip 350.

The memory chip 350 of the illustrated example may include a variety of information such as the type of fluid cartridge, the kind of fluid contained in the cartridge, an estimate of the amount of fluid remaining in the fluid reservoir 310, calibration data, error information and/or other data. In some examples, the memory chip 350 includes information about when the cartridge 300 should receive maintenance. In some examples, the printer 105 can take appropriate action based on the information contained in the memory chip 350, such as notifying the user that the fluid supply is low or altering printing routines to maintain image quality.

To print an image on the substrate 115, the example printer 105 moves the cradle carriage containing the cartridge 300 over the substrate 115. To cause an image to be printed on the substrate 115, the example printer 105 sends electrical signals to the cartridge 300 via the electrical contacts in the carriage cradle. The electrical signals pass through the conductive pads 340 of the cartridge 300 and are routed through the flexible cable 330 to the die 320. The example die 320 then ejects a small droplet of fluid from the reservoir 310 onto the surface of the substrate 115. Droplets of ink combine to form an image on the surface of the substrate 115.

Figure 4:
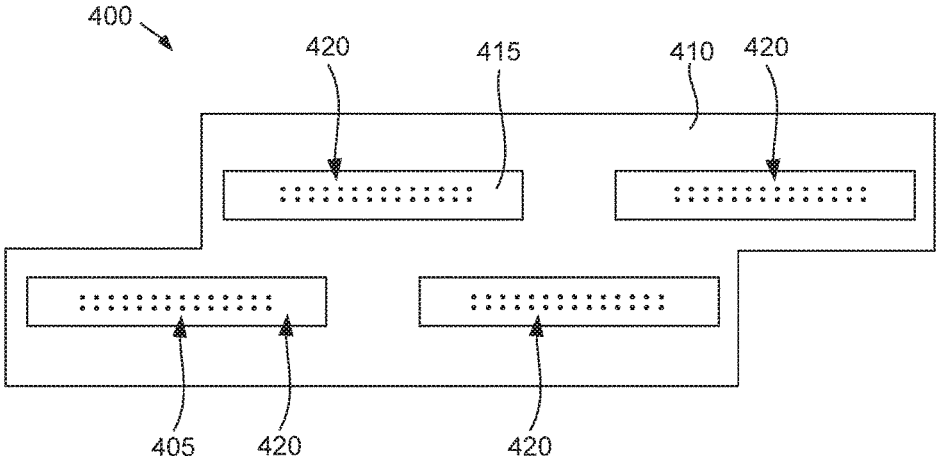
FIG. 4 illustrates an example printbar for use with a printing apparatus that can used to implement the examples disclosed herein.

FIG. 4 is a diagram of a printbar 400 (e.g., a printbar of a wide inkjet array (e.g., page wide inkjet array)) that can be used to implement the example printing apparatus 100 of FIG. 1, The example printbar 400 includes a plurality of nozzles 405, a carrier 410 and a plurality of dies 415. The individual nozzles 405 and/or the dies 415 may be communicatively coupled to the controller 120 such that each nozzle is selectively controllable to eject fluid onto the substrate 115. For example, the substrate 115 may be moved past the printbar 400 and the nozzles 405 may be controlled to eject ink onto the substrate 115 to print an image on the substrate 115.

The example nozzles 405 include an associated heater 420. The example heaters 420 are controllable between an on state and an off state. To substantially prevent ink within unused ones of the example nozzles 405 from evaporating, when imaging the substrate 115, a first subset of the nozzles 405 being used to image the substrate 115 may be heated while a second subset of the nozzles 405 not being used to image the substrate may not be heated. The first and second subsets may be selected based on the image being printed, the print area, the dimensions of the substrate 115, etc.

Figure 5:
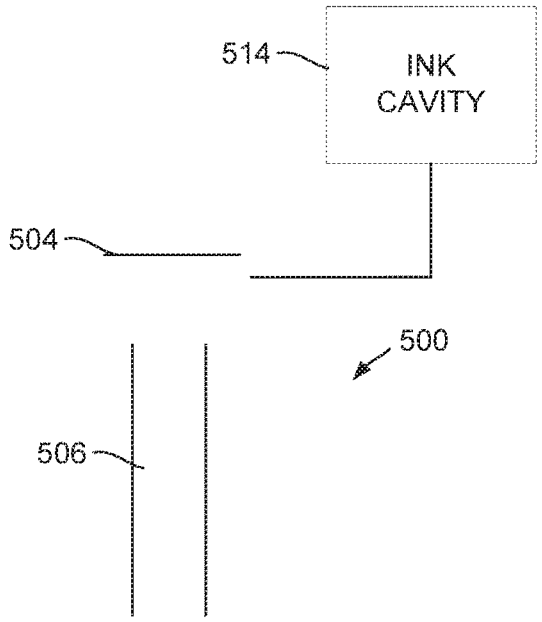
FIG. 5 illustrates an example nozzle including an example heater that can be used to implement the examples disclosed herein.

FIG. 5 show an example nozzle 500 including an example aperture 506, an example heater 504 that together can be used to implement the example nozzles 142, 305, 405, the heaters 144, 325, 420 and, generally, the examples disclosed herein.

In operation, ink obtained from an example ink cavity 514 is heated by the example heater 504 (e.g., a resistive heater) to form a bubble of ink. As the ink bubbles, it is pushed out of the example nozzle 500 to form an image on the substrate 115. To decrease the viscosity of the ink, the example heater 504 additionally heats the ink using a lower power than when ink is heated to form the bubble. In another example, a piezoelectric actuator may be utilized to eject ink whereby selective deformation of the piezoelectric actuator causes droplets of ink to be ejected. In such an example, the heater is not used to vaporize the ink, but the heater is still used to heat the ink a smaller amount to lower the viscosity of the ink. The methods and apparatus disclosed herein are not limited to a particular type of printer. On the contrary, the disclosed methods and apparatus may be utilized to selectively activate and/or deactivate heaters associated with any type of printing implement that is outside a print area.

While an example manner of implementing the printing apparatus 100 of FIG. 1 is illustrated in FIGS. 1, 3, 4, and 5, one or more of the elements, processes and/or devices illustrated in FIGS. 1, 3, 4, and/or 5 may be combined, divided, re-arranged, omitted, eliminated and/or implemented in any other way. Further, the example controller 120, the example processor 145, the example data storage device 150, the example heater controller 155 of FIG. 1, the example heater controller 205, the example print analyzer 206 of FIG. 2, and/or, more generally, the printing apparatus 100 of FIG. 1 may be implemented by hardware, software, firmware and/or any combination of hardware, software and/or firmware. Thus, for example, any of the example controller 120, the example processor 145, the example data storage device 150, the example heater controller 155 of FIG. 1, the example heater controller 205, the example print analyzer 206 of FIG. 2, and/or, more generally, the example printing apparatus 100 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example, controller 120, the example processor 145, the example data storage device 150, the example heater controller 155 of FIG. 1, the example heater controller 205, the example print analyzer 206 of FIG. 2, is/are hereby expressly defined to include a tangible computer readable storage device or storage disk such as a memory, a digital versatile disk (DVD), a compact disk (CD), a Blu-ray disk, etc. storing the software and/or firmware. Further still, the example printing apparatus 100 of FIG. 1 may include one or more elements, processes and/or devices in addition to, or instead of, those illustrated in FIGS. 1, 3, 4, and 5, and/or may include more than one of any or all of the illustrated elements, processes and devices.

Figure 6:
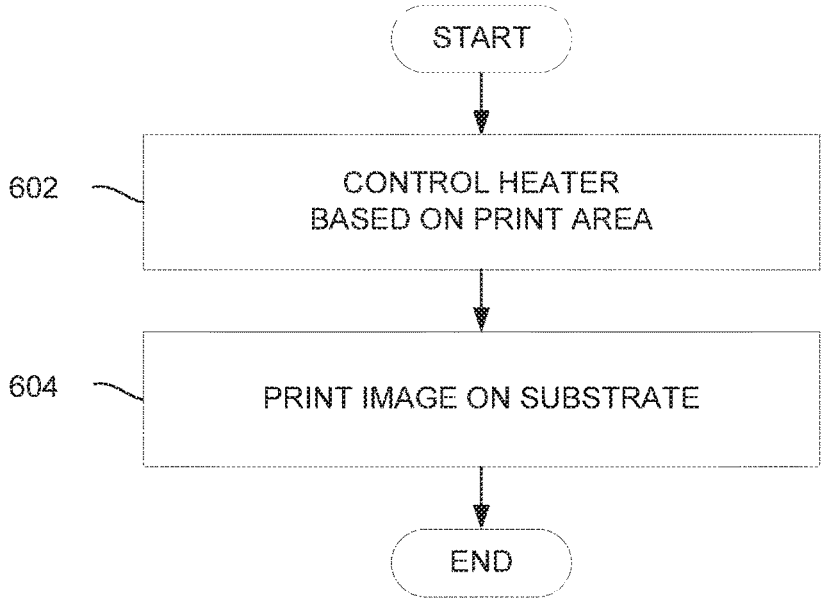
FIGS. 6 and 7 are flowcharts representative of machine readable instructions that may be executed to control fluid flow through a printhead in the printing apparatus of FIG. 1.
Figure 7:
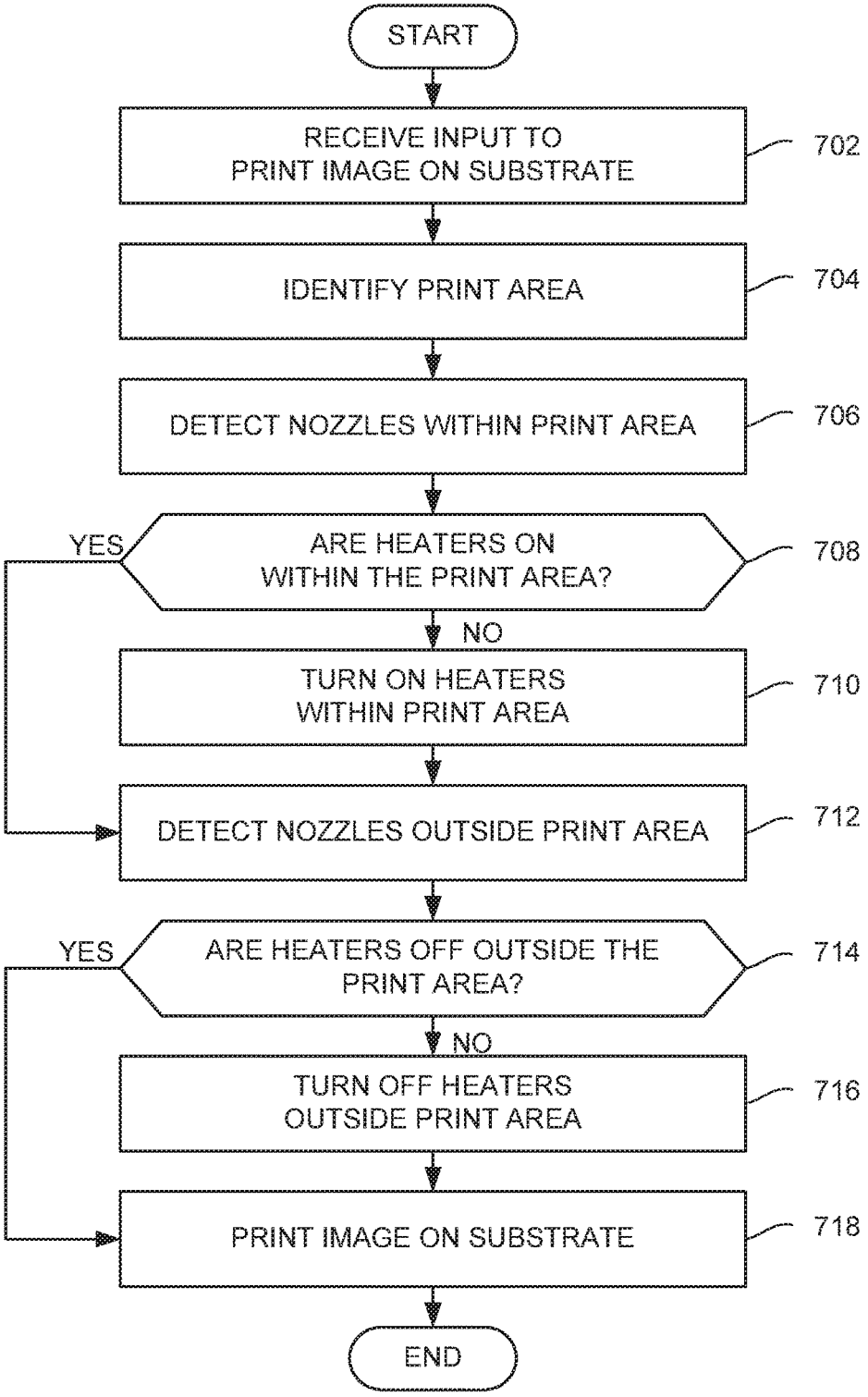

Flowcharts representative of example machine readable instructions for implementing the printing apparatus 100 are shown in FIGS. 6 and 7. In the examples, the machine readable instructions comprise programs for execution by a processor such as the processor 812 shown in the example processor platform 800 discussed below in connection with FIG. 8. The programs may be embodied in software stored on a tangible computer readable storage medium such as a CD-ROM, a floppy disk, a hard drive, a digital versatile disk (DVD), a Blu-ray disk, or a memory associated with the processor 812, but the programs and/or parts thereof could alternatively be executed by a device other than the processor 812 and/or embodied in firmware or dedicated hardware. Further, although the example programs are described with reference to the flowcharts illustrated in FIGS. 6 and 7, many other methods of implementing the example printing apparatus 100 may alternatively be used. For example, the order of execution of the blocks may be changed, and/or some of the blocks described may be changed, eliminated, or combined.

As mentioned above, the example processes of FIGS. 6 and 7 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example processes of FIGS. 6 and 7 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

The process of FIG. 6 begins by the example heater actuator 214 of FIG. 2 controlling the example heaters 144 based on a print area determined by the example image dimension analyzer 208 and/or the example substrate dimension analyzer 210 (block 602). In some examples, the print area is associated with a width and/or size of the substrate 115 on which an image is to be printed and/or is being printed as determined by the example substrate dimension analyzer 210. In some examples, the print area is associated with a width and/or size of image to be printed and/or being printed on the substrate 115 as determined by the example image dimension analyzer 208. Regardless of how the print area is determined, the heater actuator 214 controls the heaters 144 of the nozzles 142 identified by the nozzle identifier 212 to turn on the ones of the heaters 144 being used to print on the substrate 115. The heater actuator 214 controls the heaters 144 of the nozzles 142 to turn off the ones of the heaters 144 not being used to print on the substrate 115. Turning off the example heaters 144 of the unused nozzles 142 reduces evaporation and drying of ink of the unused nozzles 142.

At block 604, the example processor 145 causes an image to be printed on the substrate 115 by actuating the printhead motion mechanics 125 and/or the substrate motion mechanics 130 causing the printhead 140 to eject fluid through the respective nozzles 142.

FIG. 7 is a flowchart of another example process for controlling heaters. The process of FIG. 7 begins when the controller 120 receives input to print an image on the example substrate 115 of FIG. 1 (block 702). The input may be an input received by the printing apparatus 100 directly from a user, and/or may be received from a computer external to the printing apparatus 100, etc. At block 704, a print area is identified (block 702). In some examples, the print area is identified by the heater controller 155 implemented by the heater controller 205 of FIG. 2 based on the input received. For example, the print area may be identified when the example print analyzer 206 receives information about a requested print job and the example image dimension analyzer 208 determines the dimensions of the image to be printed and/or the example substrate dimension analyzer 210 determines the dimensions of the substrate 115. Additionally or alternatively, the print area may be identified by a computer external to the printing apparatus 100. The print area may be associated with the width of the substrate, the width of the image, the size of the substrate, the size of the image, etc.

The example nozzle identifier 212 detects the ones of the nozzles 142 that are within the print area (block 706). In some examples, the nozzles 142 within the print area are identified by the nozzle identifier 212 based on the received input. Additionally or alternatively, the print area may be identified by a computer external to the printing apparatus 100. At block 708, the example heater actuator 214 determines if the example heaters 144 of the ones of the nozzles 142 within the determined print area are on (e.g., heating the nozzles 142) (block 708). If the heaters 144 within the determined print area are off, the heater actuator 214 causes the heaters 144 to turn on (block 710).

The example nozzle identifier 212 then detects ones of the nozzles 142 outside the print area (block 712). In some examples, the ones of the nozzles 142 outside the print area are identified by the nozzle identifier 212 based on the received input. At block 714, the example heater actuator 214 determines if the heaters 144 of the ones of the nozzles 142 outside the determined print area are off (block 714). If the heaters 144 within the determined print area are on, the example heater actuator 214 causes the heaters 144 to turn off (block 716).

At block 718, the processor 145 causes an image to be printed on the substrate 115 by actuating the printhead motion mechanics 125 and/or the substrate motion mechanics 130 and/or by causing the example printhead 140 to eject fluid through the ones of nozzles 142 in the print area (block 718).

Figure 8:
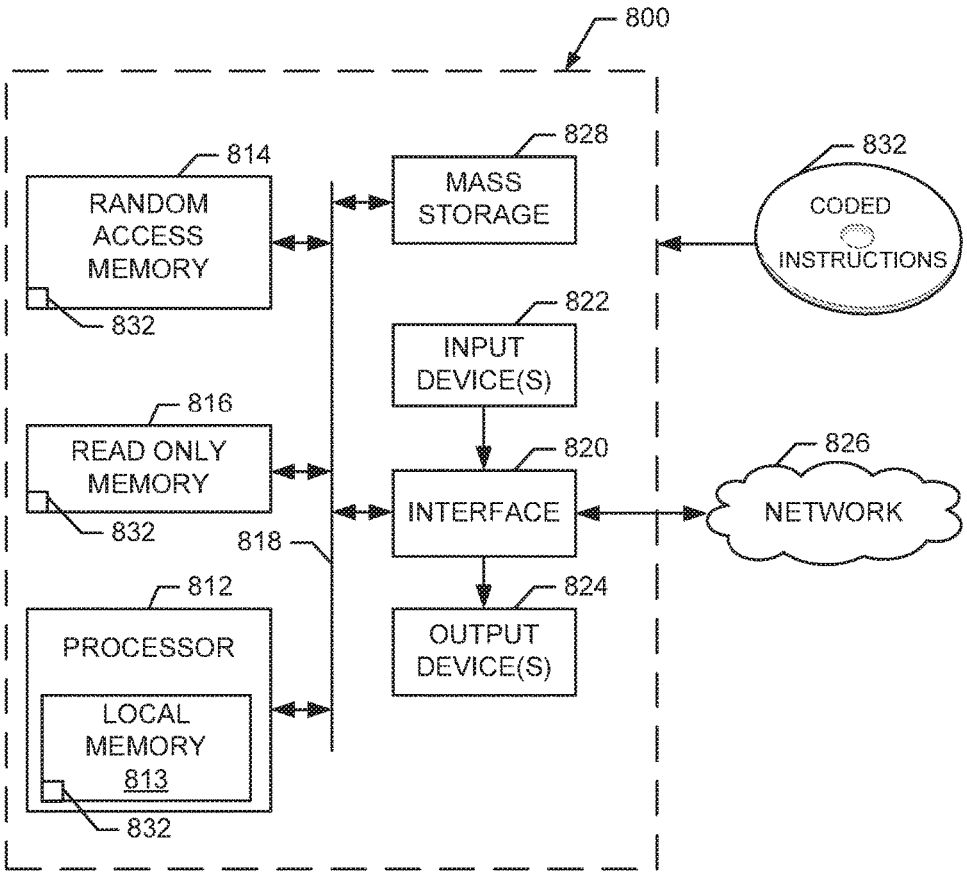
FIG. 8 is a processor platform to execute the instructions of FIGS. 4, 6 and 7 to implement the printing apparatus of FIG. 1.

FIG. 8 is a block diagram of an example processor platform 800 capable of executing the instructions of FIGS. 6 and 7 to implement the printing apparatus 100 of FIGS. 1, 3, 4, and 5. The processor platform 800 can be, for example, a server, a personal computer, a mobile device (e.g., a cell phone, a smart phone, a tablet such as an iPad™), a personal digital assistant (FDA), an Internet appliance, or any other type of computing device.

The processor platform 800 of the illustrated example includes a processor 812. The processor 812 of the illustrated example is hardware. For example, the processor 812 can be implemented by one or more integrated circuits, logic circuits, microprocessors or controllers from any desired family or manufacturer.

The processor 812 of the illustrated example includes a local memory 813 (e.g., a cache). The processor 812 of the illustrated example is in communication with a main memory including a volatile memory 814 and a non-volatile memory 816 via a bus 818. The volatile memory 814 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 816 may be implemented by flash memory and/or any other desired type of memory device. Access to the main memory 814, 816 is controlled by a memory controller.

The processor platform 800 of the illustrated example also includes an interface circuit 820. The interface circuit 820 may be implemented by any type of interface standard, such as an Ethernet interface, a universal serial bus (USB), and/or a PCI express interface.

In the illustrated example, one or more input devices 822 are connected to the interface circuit 820. The input device (s) 822 permit(s) a user to enter data and commands into the processor 145. The input device(s) can be implemented by, for example, an audio sensor, a microphone, a keyboard, a button, a mouse, a touchscreen, a track-pad, a trackball, isopoint and/or a voice recognition system.

One or more output devices 824 are also connected to the interface circuit 820 of the illustrated example. The output devices 824 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED) and/or speakers). The interface circuit 820 of the illustrated example, thus, typically includes a graphics driver card, a graphics driver chip or a graphics driver processor.

The interface circuit 820 of the illustrated example also includes a communication device such as a transmitter, a receiver, a transceiver, a modem and/or network interface card to facilitate exchange of data with external machines (e.g., computing devices of any kind) via a network 826 (e.g., an Ethernet connection, a digital subscriber line (DSL), a telephone line, coaxial cable, a cellular telephone system, etc.).

The processor platform 800 of the illustrated example also includes one or more mass storage devices 828 for storing software and/or data. Examples of such mass storage devices 828 include floppy disk drives, hard drive disks, compact disk drives, Blu-ray disk drives, RAID systems, and digital versatile disk (DVD) drives.

The coded instructions 832 of FIGS. 6 and 7 may be stored in the mass storage device 828, in the volatile memory 814, in the non-volatile memory 816, and/or on a removable tangible computer readable storage medium such as a CD or DVD.

From the foregoing, it will appreciated that the above disclosed methods, apparatus and articles of manufacture selectively control nozzle heater of a printhead and/or printbar to substantially prevent ink within non-used nozzles from evaporating. Using the examples disclosed herein, the useful life of these nozzles is extended. In some examples, these nozzle heaters may be controlled between on and off prior to a print job being initiated and/or during a print job based on a size of a substrate being imaged and/or based on a size of the image to be printed on a substrate. In some examples, the nozzle heaters may be actuated between on and off while the printing apparatus is continuously operating based on the size of the substrate being imaged and/or based on the size of the image to be produced on the substrate. While inkjet printing is described in the foregoing examples, the methods and apparatus disclosed herein may be implemented on any other type of printer that includes nozzles or on other devices that include nozzles. For example, the methods and apparatus disclosed herein can be implemented on three-dimensional printing devices.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A method comprising:

detecting, by executing an instruction with a processor, a print area based on a size of an image to be printed;

controlling, by executing an instruction with the processor, a heater associated with a printing nozzle to reduce a heat output of the heater based on a determination that the printing nozzle is outside the print area; and printing, by executing an instruction with the processor, the image on a substrate using other printing nozzles while the heat output of the heater is reduced.

2. A method as defined in claim 1, wherein the printing area is an area in which the other of the printing nozzles will print the image on the substrate during a print job.

3. A method as defined in claim 1, wherein the printing nozzle is one of a plurality of printing nozzles and the heater is associated with multiple ones of the plurality of nozzles.

4. A method as defined in claim 1, wherein the print area is further determined from at least one of a dimension of the substrate or an area identified by firmware of a printer.

5. A method as defined in claim 1, wherein controlling the heater comprises at least one of verifying that the heater is not activated, de-activating the heater, or reducing power provided to the heater.

6. A tangible computer readable medium comprising instructions that, when executed, cause a wide array inkjet printing apparatus to at least:

detect a print area based on a size of a substrate on which the inkjet printing apparatus is to print;

identify a nozzle that is outside a print area based on the size of the substrate, the nozzle included on a printbar of the wide array inkjet printing apparatus; and in response to identifying the nozzle, deactivate a heater associated with the nozzle.

7. A tangible computer readable medium as defined in claim 6, wherein the instructions, when executed, cause the printing apparatus to print an image in the print area while the heater is deactivated.

8. A tangible computer readable medium as defined in claim 6, wherein the instructions, when executed, cause the printing apparatus to deactivate the heater by reducing power supplied to the heater.

9. A tangible computer readable medium as defined in claim 6, wherein the instructions, when executed, cause the printing apparatus to activate a second heater associated with a second nozzle that is inside the print area.

10. A tangible computer readable medium as defined claim 6, wherein the instructions, when executed, cause the printing apparatus to:

detect that the heater is activated; and in response to identifying the nozzle and detecting that the heater is activated, deactivate the heater associated with the nozzle.

11. A printing apparatus comprising:

a heater to heat a nozzle; and a heater controller to turn off the heater when the nozzle is outside a print area, wherein the heater controller includes a substrate dimension analyzer to detect the print area based on a size of a substrate on which the printing apparatus is printing.

12. A printing apparatus as defined in claim 11, wherein the nozzle ejects ink.

13. A printing apparatus comprising:

a heater to heat a nozzle; and a heater controller to turn off the heater when the nozzle is outside a print area, wherein the heater controller includes an image dimension analyzer to detect the print area based on a size of an image to be printed by the printing apparatus.

14. A printing apparatus as defined in claim 13, wherein the heater controller turns off the heater by switching off power to the heater.

* * * * *